US006206358B1

(12) United States Patent
Yamaguchi et al.

(10) Patent No.: US 6,206,358 B1
(45) Date of Patent: Mar. 27, 2001

(54) BOOK BINDING SYSTEM

(75) Inventors: Katsumi Yamaguchi, Otsu; Eiji Katayama, Kyoto; Hisahiro Hirayama; Hiroyuki Ono, both of Shiga, all of (JP)

(73) Assignee: Horizon International Inc., Shinasahimachi ( * ) Notice: Subject to any disclaimer, the term of this patent is extended or adjusted under 35 U.S.C. 154(b) by 0 days.

(21) Appl. No.: 09/115,044

(22) Filed: Jul. 14, 1998

(30) Foreign Application Priority Data

Aug. 4, 1997 (JP) ..... 9-243295
Dec. 22, 1997 (JP) ..... 9-370186

(51) Int. Cl.[7] ..... B42B 2/00
(52) U.S. Cl. ..... 270/52.02; 412/11
(58) Field of Search ..... 412/11, 13, 14, 412/4, 19, 8, 12; 364/478.09, 478.12; 270/52.02

(56) References Cited

U.S. PATENT DOCUMENTS

| | | | | |
|---|---|---|---|---|
| 3,816,866 | * | 6/1974 | Miaskoff et al. | 270/56 X |
| 4,121,218 | | 10/1978 | Riley et al. . | |
| 4,121,818 | * | 10/1978 | Riley et al. | 270/54 |
| 5,061,138 | * | 10/1991 | Allsopp et al. | 412/4 |
| 5,112,179 | * | 5/1992 | Chan et al. | 412/1 |
| 5,114,291 | | 5/1992 | Hefty . | |
| 5,465,213 | * | 11/1995 | Ross | 364/468 |
| 5,569,012 | * | 10/1996 | Kosasa et al. | 412/33 |
| 5,634,633 | * | 6/1997 | Graushar | 270/58.05 |
| 5,735,659 | * | 4/1998 | Kosasa et al. | 412/9 |
| 5,838,574 | * | 11/1998 | Olson et al. | 364/478.07 |
| 5,855,464 | * | 1/1999 | Bennett | 412/39 |
| 5,863,372 | * | 1/1999 | Fabel | 412/6 X |
| 5,899,649 | * | 5/1999 | Kohtani et al. | 412/11 |
| 5,941,671 | * | 8/1999 | Wehrle | 412/8 |

FOREIGN PATENT DOCUMENTS

| | | |
|---|---|---|
| 0 386 787 A2 | 9/1990 | (EP) . |
| 8-143864 | 5/1994 | (JP) . |
| 8-125824 | 5/1996 | (JP) . |

OTHER PUBLICATIONS

European Search Report in EP98–25–0260, completed Nov. 9, 1998 (corresponding to U.S. Appln. Ser. No. 09/115,044).

* cited by examiner

*Primary Examiner*—Christopher P. Ellis
*Assistant Examiner*—Richard Ridley
(74) *Attorney, Agent, or Firm*—Morgan & Finnegan, LLP

(57) ABSTRACT

Servers (4*a*, 4*b*) respectively define printing informations (2*b*, 3*b*) inclusive of identifying informations ID1, ID2 of a paper block (2) and a cover (3) whereas printing machines (1*a*, 1*b*) respectively perform a printing operation on the paper block (2) and the cover (3). Information readers (6*a*, 6*b*) respectively read the printing informations of the paper block (2) and the cover (3) so as to supply the information thus acquired to a book-binding controller (7). Based on either of the informations thus supplied, the book-binding controller (7) supplies a book binding apparatus (20) or (80) with a control signal (CS) of settings for the book binding process. Additionally, the control signal (CS) of the settings for the book binding process is outputted when the ID1 and ID2 are in correspondence. Based on the printing information of the paper block, respective quantities of movement of the laterally movable members (31, 32, 42, 43, 61, 62) are automatically regulated.

5 Claims, 8 Drawing Sheets

BOOK BINDING SYSTEM

BACKGROUND OF THE INVENTION

The present invention generally relates to a book binding apparatus which is adapted to apply covers to paper blocks.

In the printing machines (copying machines) known to the art, copies of a book are produced by printing based on a block of required number of sheets per page. The sheet blocks corresponding to respective pages of the book are subject to a collator for forming collated blocks of printed sheets. The collated sheet blocks are transported to a book binding machine or a book sewing machine so as to be bound in a suitable manner. It is general practice in the art to employ the book binding machine for binding a collated paper block of a great thickness by gluing and the book sewing machine for sewing a collated sheet block of a relatively small thickness. Such book binding machines and book sewing machines will hereinafter be collectively referred to as 'book binding apparatus'.

More recently, there has been developed a printing machine adapted to sequentially print on a one-sheet-per-page basis and discharge copies in the order of pages. Such a printing machine permits discharged sheets to be gathered in collated blocks which may be readily bound. In this connection, studies have been made to accomplish continuous processing steps from printing to binding by coupling the printing machine to the book binding apparatus.

FIG. 7 is a schematic perspective view showing an exemplary arrangement in which a printing machine is coupled to a book binding apparatus adapted to bind books by gluing. Referring to the figure, a book binding apparatus 20 includes a binding start station 30, a milling station 40, a gluing station 50 and a covering station 60. A printing machine 1*a* feeds a collated block of printed sheets 2 to a collated block gathering station 2*a* whereas a printing machine 1*b* feeds a printed cover sheet 3 to a cover sheet gathering station 3*a*, the cover sheet 3 having about double the size of the collated block.

The collated block 2 is transported to the binding start station 30 via transport means, such as a conveyor belt or the like. When the book binding process is started, the collated block 2 is placed on a level plate 33 on its spine, as held between clampers 31 and 32, a lateral movement of which clampers is regulated in quantity according to a thickness of the collated block 2. In this state, the collated block is fed to the milling station 40 for the subsequent steps (as to the subsequent steps, illustrations of the clampers 31, 32 are omitted in the figure).

The milling station 40 includes a milling machine 41 and width-adjustment plates 42 and 43. The milling station 40 is adjusted in a quantity of lateral movement of the width-adjustment plates 42 and 43 according to the thickness of the collated block 2 so that the collated block 2 is aligned flush against a top surface of the milling machine 41 as allowed to pass thereover. Thus, a pre-processing is carried out for allowing a glue to be uniformly applied to the spine of the block. Subsequently, the collated block 2 with its spine aligned flush is fed to the gluing station 50. The gluing station 50 includes a gluing device 54 arranged such that a glue tank 51 contains therein a glue 5 with an application roller 53 immersed therein. The collated block 2 is subject to a gluing process so as to be applied with the glue to its spine. The glue in the glue tank 51 is heated to a suitable temperature for facilitating the application of the glue to the spine of the collated block 2.

Subsequent to the gluing process, the collated block 2 is fed to the covering station 60. In the covering station 60, the printed cover sheet 3 is already delivered onto nipper plates (squeezing plates) 61, 62 and a base plate 63 from the cover sheet gathering station 3*a* via a suitable transport means such as a conveyor belt or the like. The collated block 2 through the gluing process is fed to the cover sheet on the nipper plates 61, 62 and the base plate 63 so as to be bonded thereto on its spine. Then, the nipper plates 61, 62 are laterally moved by a predetermined quantity and pressed against lateral end portions of the spine of the collated block 2 from opposite sides (hereinafter referred to as 'nipping') thereby folding the cover sheet and holding the block between the folded cover sheet. Thus, the cover sheet is bonded to the collated block. The quantity of lateral movement of the nipper plates is defined with consideration given to thicknesses of the collated block 2 and the cover sheet.

The clampers 31, 32 of the binding start station 30, the width-adjustment plates 42, 43 of the milling station 40 and the nipper plates 61, 62 of the covering station 60 each constitute a laterally movable member adapted for lateral movement based on the thickness of the collated block. The laterally movable member is driven by way of suitable drive means. A clamping width and a milling width are set to predetermined values through regulation of the quantity of movement of the laterally movable members. A nipping width is set to a predetermined value with the thickness of the cover sheet taken into consideration.

FIG. 8 is a schematic perspective view showing an arrangement of a book binding apparatus for performing the sewing process by using a stitching head. Referring to the figure, the book binding apparatus 80 includes a binding start station 81, a sewing station 82, a folding station 83, a pressing station 84, and a product gathering station 85. A collated block 2 through the printing machine is fed to the binding start station 81. On the other hand, a cover sheet 3 through the printing machine and of the same size with the collated block is transported along a direction of the arrow R in the figure to the binding start station and laid over the collated block 2.

Subsequently, the collated block 2 with the cover sheet 3 laid thereover is fed to the sewing station 82, where an unillustrated stitcher is registered to place so as to apply stitching heads 82*a*, 82*b* along a direction of the arrow P to the collated block 2 with the cover sheet 3 at predetermined positions, such as a center line thereof, thus accomplishing the sewing process. Thereafter, the collated block thus bound is fed to the folding station 83. A gap T between folding rollers 83*a*, 83*b* of the folding station 83 is already adjusted based on the thickness of the collated block 2.

A crimp is produced in the collated block 2 with the cover sheet 3 by passing through the gap between the folding rollers 83*a*, 83*b* while pressing an unillustrated fold knife against the stitched line. Although the arrangement is not illustrated in detail, both the binding process for sewing the collated block by means of the aforesaid stitcher and the folding process by means of the fold knife and the folding rollers in cooperation are techniques already known to the art.

The collated block through the sewing process is fed to the pressing station 84. In this station, a press plate 84*a* is lowered along a direction of the arrow Q to press a free end portion of the collated block 2, the free end portion being in opposed relation to the stitched end portion thereof. Thus, the collated block is formed into shape. The collated block 2 thus shaped is delivered to the product gathering station 85. In some cases, three or more stitching positions of the stitching heads may be provided on the collated block depending upon the size or thickness of the block. Additionally, the collated block 2 may be bound with the stitching head at a corner portion thereof.

The book binding apparatus of FIG. 7, which is adapted to bind the collated block by gluing, includes a plurality of laterally movable members and drive means for laterally moving these movable members, respectively. The book binding apparatus of FIG. 8, which is adapted to bind the collated block with the stitching heads, includes drive means for respectively driving the movable members which include the stitcher, fold knife, folding rollers and press plate. Thus, the book binding apparatus includes various drive means for performing the book binding process, which drive means require individual settings for their operative states based on the size and thickness of the block to be bound, properties and characteristics of sheets and the like.

SUMMARY OF THE INVENTION

It is common practice in the art that an operator makes settings for the book binding process or put the aforesaid drive means into operative states by manually handling required parameters after the cover sheets and the collated blocks are actually delivered to the book binding apparatus. This not only takes a great amount of time for making the settings for the binding process but also involves a great amount of labor of the operator.

In addition, there exists a concern about human errors in which a collated block and a cover sheet in wrong correspondence are bound together because the printed sheet block and cover sheet are delivered to the book binding apparatus via different routes.

Furthermore, in the book binding apparatus requiring operations for setting the clamping width, the milling width and the nipping width through adjustment of quantities of movement of the laterally movable members with consideration given to the thicknesses of the block and cover sheet to be bound together, the quantities of movement of the laterally movable members are conventionally adjusted by skilled operators using tools. Hence, the adjusting operation is cumbersome with low working efficiency.

An object of the invention is, therefore, to provide a book binding apparatus adapted for automatic settings for the binding process and prevention of the binding of the collated block and cover sheet in wrong correspondence, and featuring an improved operation for adjustment of the quantities of movement of the laterally movable members based on the collated block and cover sheet to be bound together.

For achieving the above objects, the book binding apparatus in accordance with a first aspect of the invention comprises a cover sheet transport passage for being supplied with a cover sheet having a printing information inclusive of an identifying information thereof printed thereon; a sheet block transport passage for being supplied with a block of sheets having a printing information inclusive of an identifying information thereof printed thereon; an information reader for reading the printing informations of the cover and of the sheet block; and a book-binding controller for making settings for a book binding process based on either of the printing informations of the cover and the sheet block.

For achieving the above objects, the book binding apparatus in accordance with a second aspect of the invention comprises a cover sheet transport passage for being supplied with a cover sheet having a printing information inclusive of an identifying information thereof printed thereon; a sheet block transport passage for being supplied with a block of sheets having a printing information inclusive of an identifying information thereof printed thereon; an information reader for reading the printing informations of the cover and of the sheet block; and a book-binding controller making comparison between the identifying informations of the cover and the sheet block read by the information reader so as to make settings for a printing process when both the identifying informations correspond to each other.

Again for achieving the above object, the book binding apparatus in accordance with a third aspect of the invention comprises a cover sheet transport passage for being supplied with a cover sheet having a printing information inclusive of an identifying information thereof printed thereon; a sheet block transport passage for being supplied with a block of sheets having a printing information inclusive of an identifying information thereof printed thereon; an information reader for reading the printing informations of the cover and of the sheet block; a plurality of laterally movable members coupled to drive means, respectively, for control of movement thereof based on a thickness of the sheet block; and a book-binding controller making comparison between the identifying informations of the cover and the sheet block read by the information reader so as to output a command for initiating a book binding process and to supply a control signal to the drive means based on the printing informations of the cover and the sheet block when both the identifying informations correspond to each other, the book binding apparatus wherein the drive means are controlled by the control signal for control of movement of the laterally movable members before the cover sheet and the sheet block are supplied to the apparatus for the book binding process.

In the arrangement of the first aspect of the invention, either of the printing informations of the cover and the sheet block is read for automatically making settings for the book binding process based on the information thus acquired. This reduces not only time required for the settings for the binding process but also labor spent by the operator.

In the arrangement of the second aspect of the invention, the settings for the book binding process are made only when the identifying informations of the sheet block and the cover are in correspondence. This is effective to prevent the occurrence of human errors in which the sheet block and the cover sheet in wrong correspondence are bound together.

In arrangement of the third aspect of the invention, the quantities of movement of the laterally movable members are automatically regulated based on the printing informations of the sheet block and the cover sheet to be bound together. This is effective to increase the working efficiency of the operation for adjustment of the quantities of movement of the laterally movable members.

BRIEF DESCRIPTION OF THE DRAWINGS

The other objects and features of this invention will become understood from the following description with reference to the accompanying drawings in which.

DETAILED DESCRIPTION OF THE PREFERRED EMBODIMENT

Figure 7:
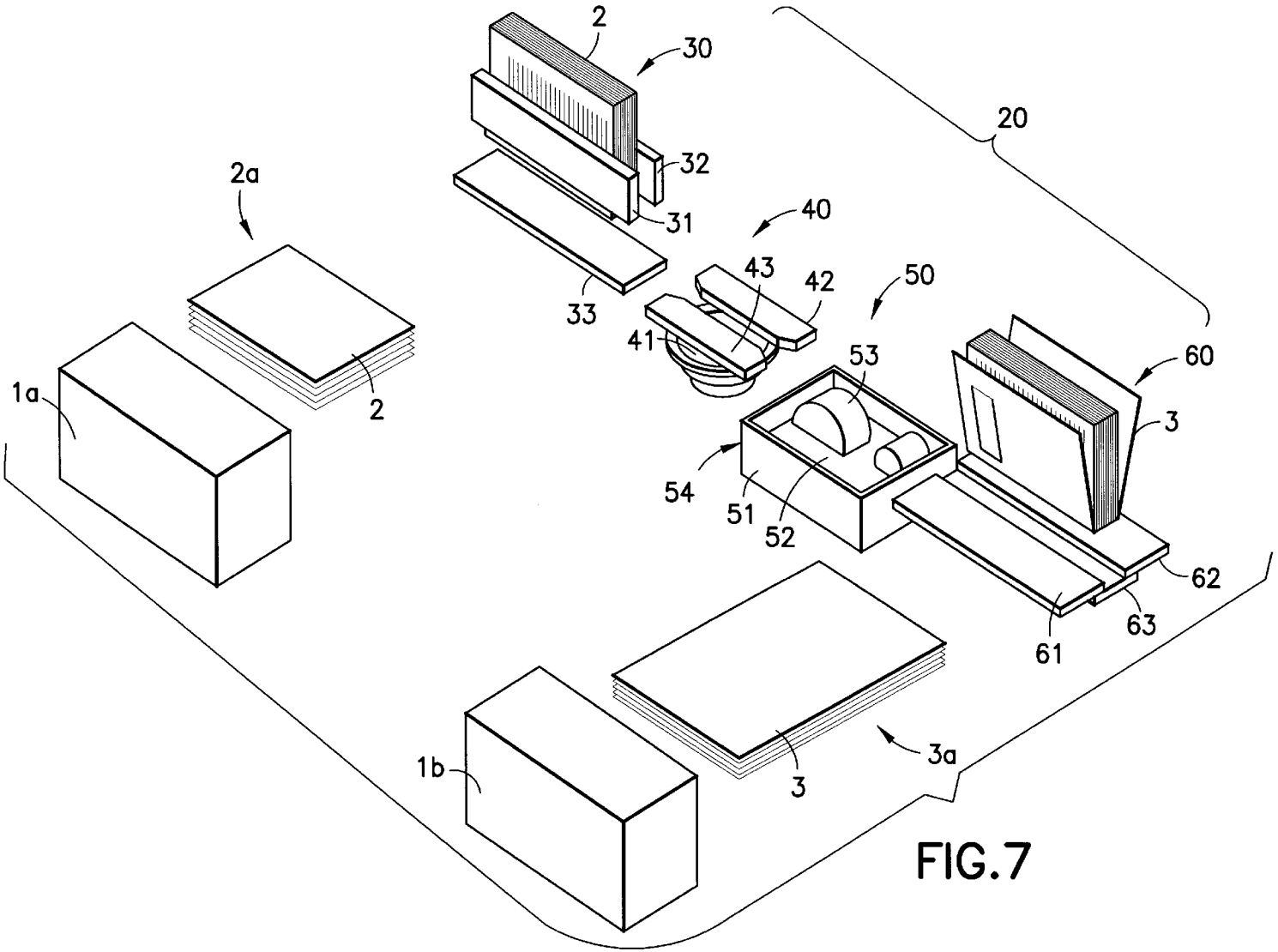
FIG. 7 is a schematic perspective view showing an arrangement of a book binding machine for binding books by gluing which machine is coupled to printing machines.

Now, a book binding machine according to an embodiment of the invention will be described by way of example of the book binding machine of the arrangement shown in FIG. 7 and with reference to a block diagram in FIG. 1. Like parts or corresponding parts to those of FIG. 7 are designated by like reference symbols, respectively. A first server 4*a* defines pieces of printing information on a paper block 2. The printing information defined by the first server 4*a* includes a number of pages, a type of paper, a sheet thickness, a type of cover sheet and the like as well as an identifying information ID1 (hereinafter referred to as 'ID') for differentiation of the paper block from other paper blocks.

A first transmission line 5*a* serves to transmit the printing information defined by the first server 4*a* to a first printing machine 1*a* and employs a telephone line, an intra-company LAN (Local Area Network) or the like. The first printing machine 1*a* performs a predetermined printing operation on the paper block 2 based on the printing information defined by the first server 4*a*. A printing information 2*b* of the paper block 2 is printed on a separate sheet to be attached to the paper block 2. The printing information 2*b* is printed in a coded form, such as bar codes, for permitting automatic recognition by a computer.

A first information reader 6*a*, such as a bar code reader, reads the coded printing information 2*b* defined for the paper block 2. The printing information 2*b* read by the first information reader 6*a* is supplied to a book-binding controller 7.

A second server 4*b* defines a printing information on a cover 3. The printing information defined by the second server 4*b* includes nature and type of paper used as the cover sheet as well as an identification ID2 for differentiation of the cover sheet 3 from other cover sheets. The printing information of the cover 3 defined by the second server 4*b* is transmitted to a second printing machine 1*b* via a second transmission line 5*b* which employs the telephone line or intracompany LAN like the first transmission line. The second printing machine 1*b*, in turn, performs a printing operation on the cover sheet based on the printing information thus supplied and also prints a cover printing information 3*b* inclusive of the ID2 on a part of the cover sheet. Similarly to the above, this printing information 3*b* is printed in the coded form, such as bar codes, for permitting the automatic recognition by the computer.

A second information reader 6*b* reads the coded printing information 3*b* defined for the cover 3 and employs a bar code reader, for example. The printing information 3*b* read by the second information reader 6*b* is supplied to the book-binding controller 7. The book-binding controller 7 is composed of, for example, a computer. The book-binding controller 7 generates a control signal CS based on either or both of the printing informations 2*b*, 3*b* of the paper block 2 and the cover 3. The resultant signal CS is supplied to a book binding apparatus 20.

The book binding apparatus 20 includes a display A, which includes a user interface (UI). At the book binding apparatus 20, settings for a book binding process are made before performance of the book binding process based on the control signal CS. Specifically, various driving means are set to operative states for regulating a clamping width of a binding start station, a milling width of a milling station, and a nipping width of a covering station.

Figure 1:
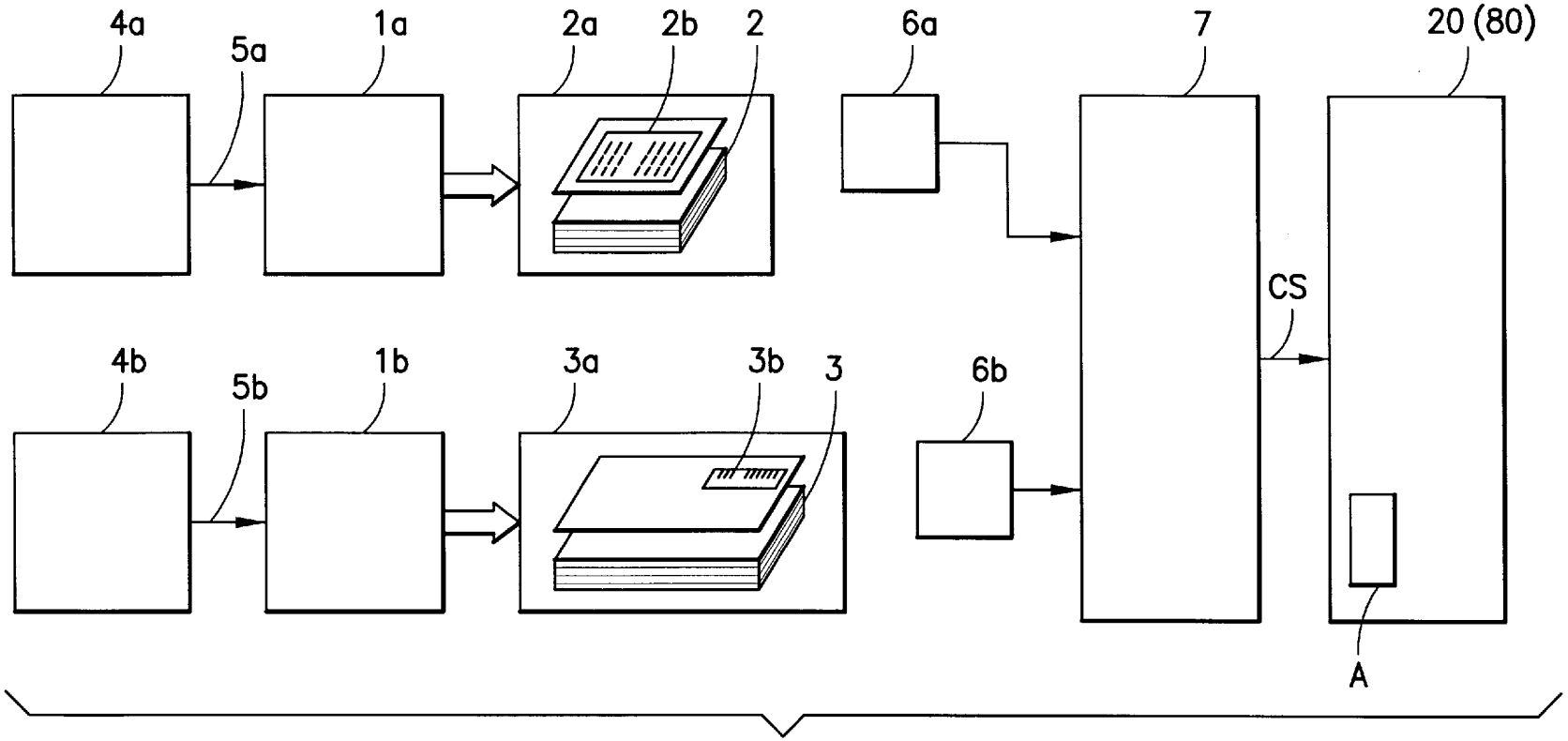
FIG. 1 is a schematic diagram showing an arrangement of a book binding apparatus according to an embodiment of the invention.
Figure 8:
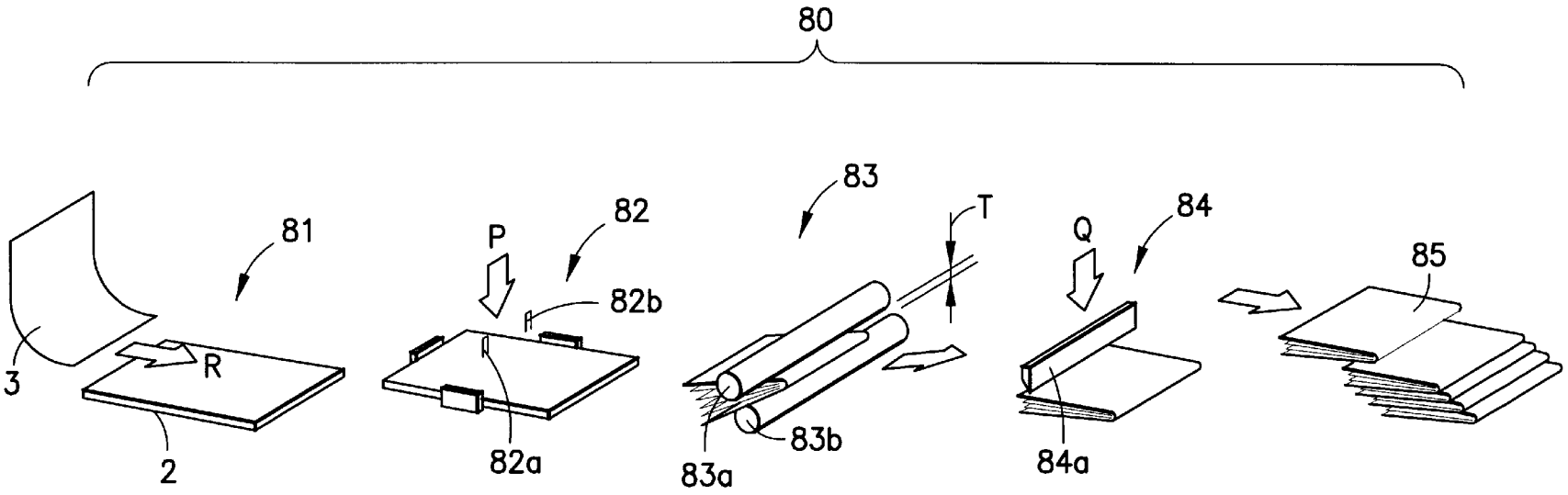
FIG. 8 is a schematic perspective view showing an arrangement of a book binding machine for binding books by sewing.

The block diagram of FIG. 1 is also applicable to a book binding apparatus 80 shown in FIG. 8. Similarly to the example of the book binding apparatus 20, this book binding apparatus 80 performs the operations which include the definition of the printing informations by means of the servers 4*a* and 4*b*; the printing on a block of sheets 2 and a cover sheet by means of the printing machines 1*a* and 1*b*; the reading of the printing information 2*b* of the paper block 2 by the first information reader 6*a*; and the reading of the printing information 3*b* of the cover 3 by means of the second information reader 6*b*. The book-binding controller 7 generates a control signal CS based on either or both of the printing informations 2*b* and 3*b* of the paper block 2 and of the cover 3. The resultant signal CS is supplied to the book binding apparatus 80.

Based on the control signal CS, the book binding apparatus 80 makes settings for the book binding process before starting the book binding operations. In this case, respective driving means for movable members are set to operative states, the movable members including a stitcher for sewing the paper block by means of a stitching head, a fold knife and folding rollers for folding the paper block, and a press plate of a pressing station.

Figure 2:
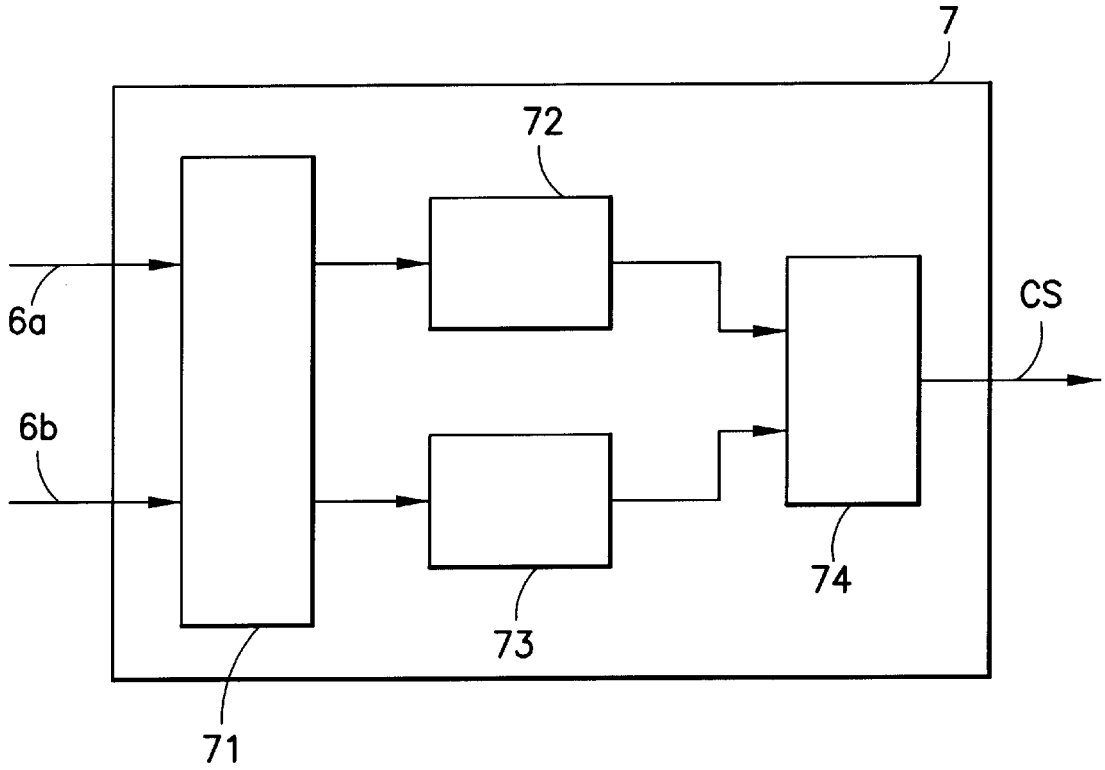
FIG. 2 is a schematic diagram showing an arrangement of the book-binding controller of FIG. 1.

FIG. 2 is a schematic diagram showing an arrangement of the book-binding controller 7. Referring to the figure, a signal conversion station 71 converts the printing informations 2*b*, 3*b* read by the first and second information readers 6*a*, 6*b* into digital signal. Indicated at 72 is a memory for storing the printing information 2*b* of the paper block and at 73 is a memory for storing the printing information 3*b* of the cover. The memories 72 and 73 are composed of RAM (Random Access Memory), for example. The aforesaid control signal CS is generated by a processing station 74.

The processing station 74 includes a comparison/determination circuit which compares the printing information 2*b* of the paper block 2 held by the memory 72 to the printing information 3*b* of the cover 3 held by the memory 73 for determining whether the ID1 included in the printing information 2*b* of the paper block 2 corresponds to the ID2 included in the printing information of the cover 3 or not.

Figure 3:
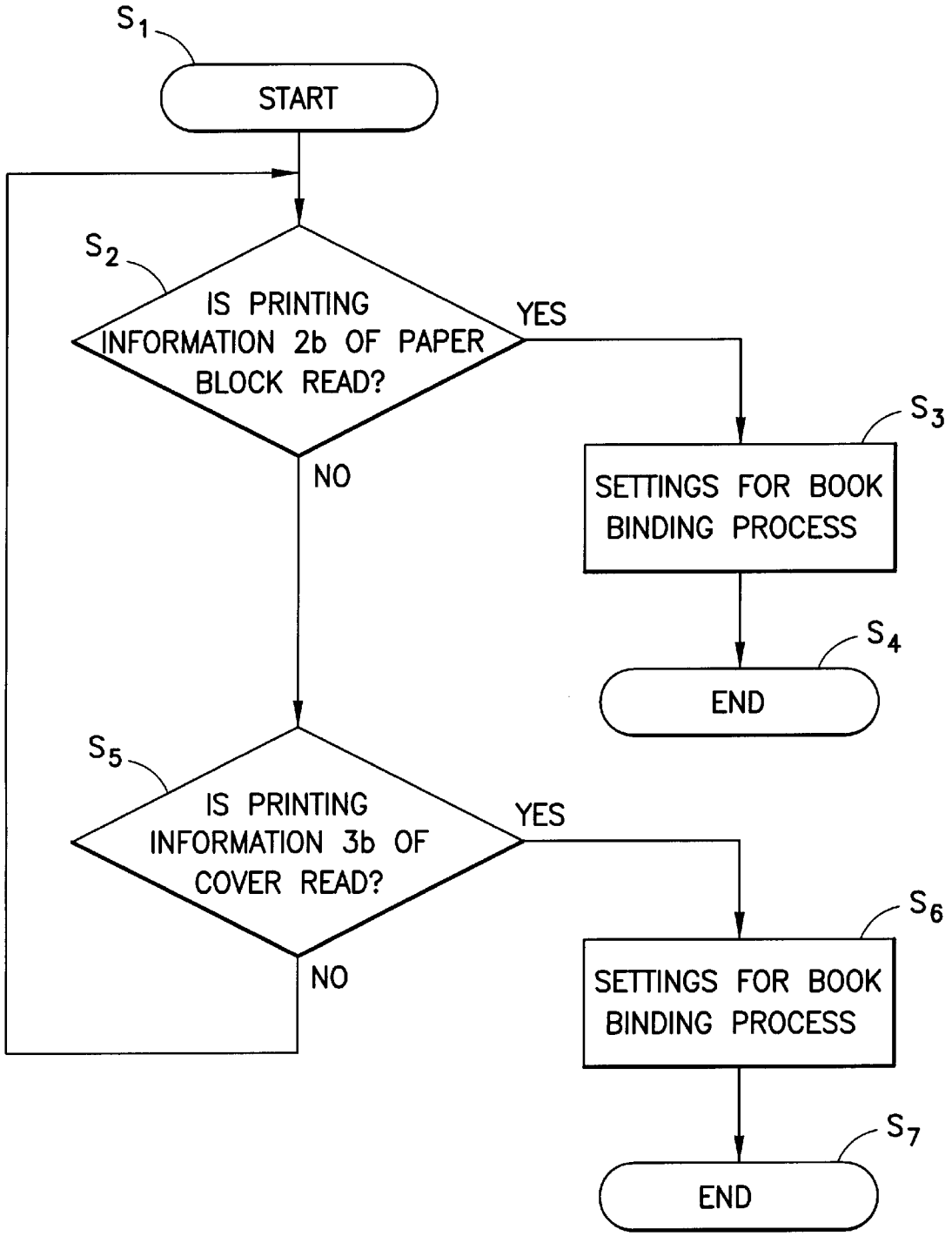
FIG. 3 is a flow chart for illustrating an exemplary procedure of book binding steps according to an embodiment of the invention.

FIG. 3 is a flow chart for illustrating an example of procedure taken by the book binding apparatus 7. Now, description will be made on the flow chart.

First, a processing program is started at Step S1, which is followed by Step S2 in which it is determined whether the printing information 2*b* of the paper block 2 is read from the memory 72 or not. If it is determined 'YES' (hereinafter simplified as 'Y'), the control flow proceeds to Step S3 in which the settings for the book binding process are made, followed by Step S4 to terminate the processing program.

If the determination at Step S2 is 'NO' (hereinafter simplified as 'N'), the control flow proceeds to Step S5 in which whether the printing information 3*b* of the cover 3 is read from the memory 73 or not is determined. If it is determined 'Y', the control flow proceeds to Step S6 to make settings for the book binding process. Subsequently, the program is terminated at Step S7. If the determination at Step S5 is 'N', the control flow returns to Step S2.

Prior to the book binding process, the book-binding controller 7 reads either of the printing informations 2*b* and 3*b* of the paper block 2 and the cover 3 for determination of a size and thickness of the paper block to be bound. Subsequently, the book-binding controller generates a control signal of settings for the book binding process and supplies the resultant signal to the book binding apparatus.

Figure 4:
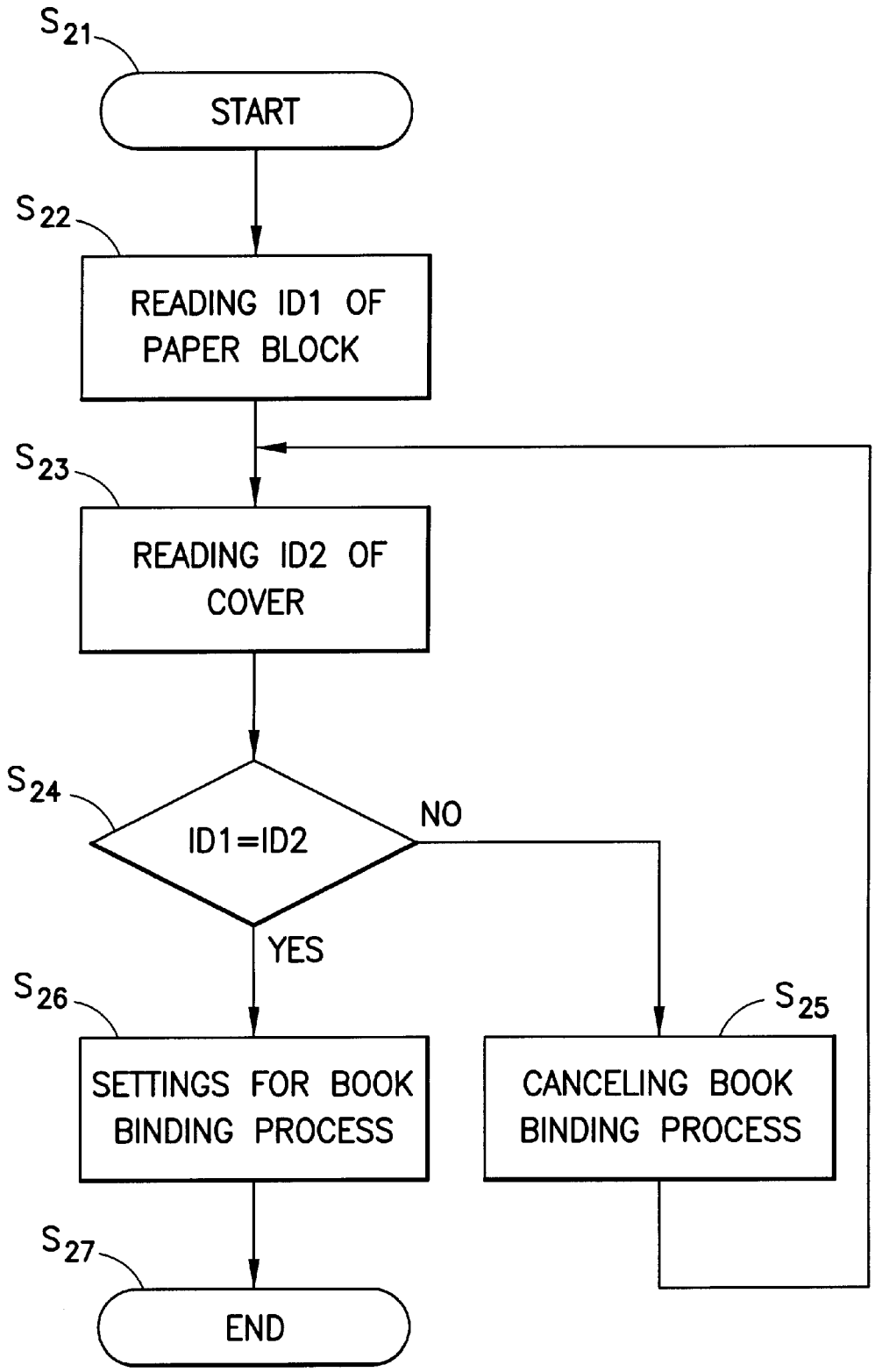
FIG. 4 is a flow chart for illustrating another exemplary procedure of book binding steps according to the embodiment of the invention.

FIG. 4 is a flow chart for illustrating another example of procedure taken by the book binding apparatus 7. Now, description will be made on this flow chart.

First, a processing program is started at Step S21. Then Step S22 follows to read from the memory 72, the ID1 included in the printing information 2*b* of the paper block 2. Step S23 follows to read the ID2 included in the printing information 3*b* of the cover 3 from the memory 73.

At Step S24, a comparison is made between the ID1 of the paper block 2 and the ID2 of the cover 3. If the ID1 does not correspond to the ID2, the detemination of 'N' is given and followed by Step S25 to output a command to cancel the book binding process. This cancellation signal is displayed at the display A which is provided at the book binding apparatus 20 or 80 and includes the user interface UI.

In this case, the cover 3 is replaced with another cover 3, a printing information 3*b* of which is read by the second information reader 6*b*. With the printing information 3*b* inputted by the second information reader 6*b*, Step S23 is performed again to read an ID2 included in the printing information 3*b* of the replacing cover 3. Subsequently, a comparison is made between the ID1 and ID2 at Step S24. Thereafter, the processing steps of minor loop from Step S23 to Step S25 are repeated until the ID1 corresponds to the ID2.

In a case where the ID1 and ID2 are in correspondence, Step S24 gives the determination of 'Y'. Subsequently, a control signal of settings for the book binding process is supplied to the book binding apparatus 20 or 80 at Step S26, which is followed by Step S27 to terminate the processing program.

In this example, prior to the start of the book binding process, the book-binding controller 7 generates the control signal of settings for the book binding process when the ID1 of the paper block 2 corresponds to the ID2 of the cover 3 or when there is correspondence between specific informations to the paper block 2 and to the cover 3 which are to be bound together.

Figure 5:
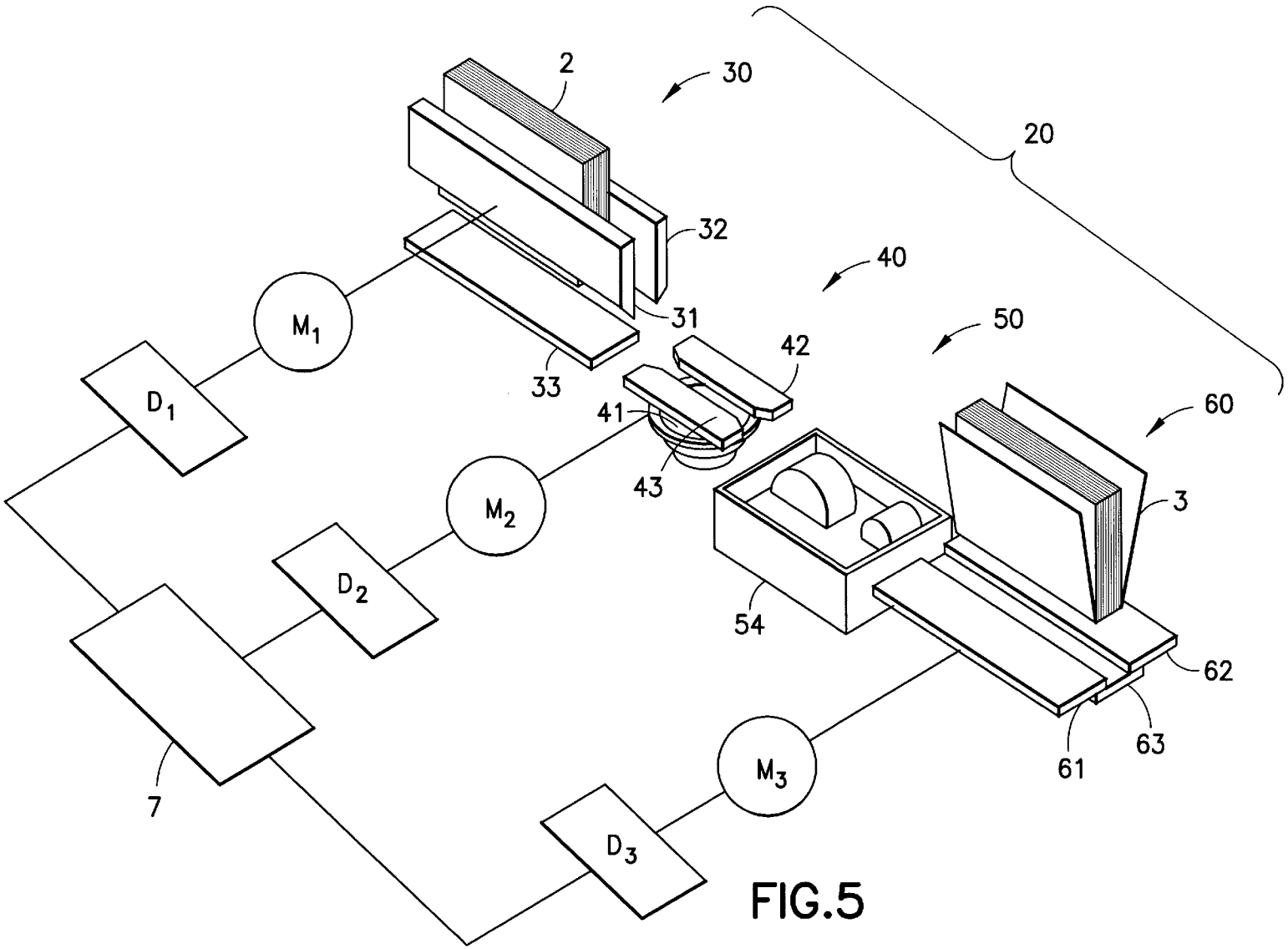
FIG. 5 is a schematic diagram showing an exemplary arrangement for regulating quantities of movement of laterally movable members of the book binding apparatus according to the invention.

FIG. 5 is a schematic diagram showing an exemplary arrangement of a mechanism for adjusting quantities of movement of laterally movable members of the book binding apparatus 20. In this book binding apparatus 20, respective components thereof correspond to those of the exemplary arrangement of FIG. 7 and therefore, like parts are designated by like symbols, respectively. Automatic gap adjustments between clampers 31, 32 of the binding start station 30, between width-adjustment plates 42, 43 of the milling station 40, and between nipper plates 61, 62 of the covering station 60 are accomplished in the following manner, such members laterally movable according to a thickness of the paper block. Either of the respective pairs of the laterally movable members are fixed to place while the others are coupled to respective drive means such that input of the control signal CS to the drive means causes a given quantity of movement of the respective drive means which are coupled to the respective movable members.

Examples of the drive means coupled to the laterally movable members include hydraulic means and electrical means. According to the example of FIG. 5, the laterally movable members are driven by motors M1, M2 and M4, respectively. Output shafts of the motors M1, M2 and M3 are respectively coupled to the laterally movable members by means of a known mechanical linkage mechanism, such as pinion, rack and the like, which mechanism converts a rotary motion of the motor into a linear motion.

The motors M1, M2 and M3 are connected to drive circuits D1, D2 and D3, respectively, which in turn are connected to the book-binding controller 7. The book-binding controller 7 generates the control signal CS, as described in the foregoing, for supplying the signal to the drive circuits D1, D2 and D3. The drive circuits are responsive to the control signal to drive the respective motors M1, M2 and M3 for automatic regulation of the respective quantities of movement of the laterally movable members.

Figure 6:
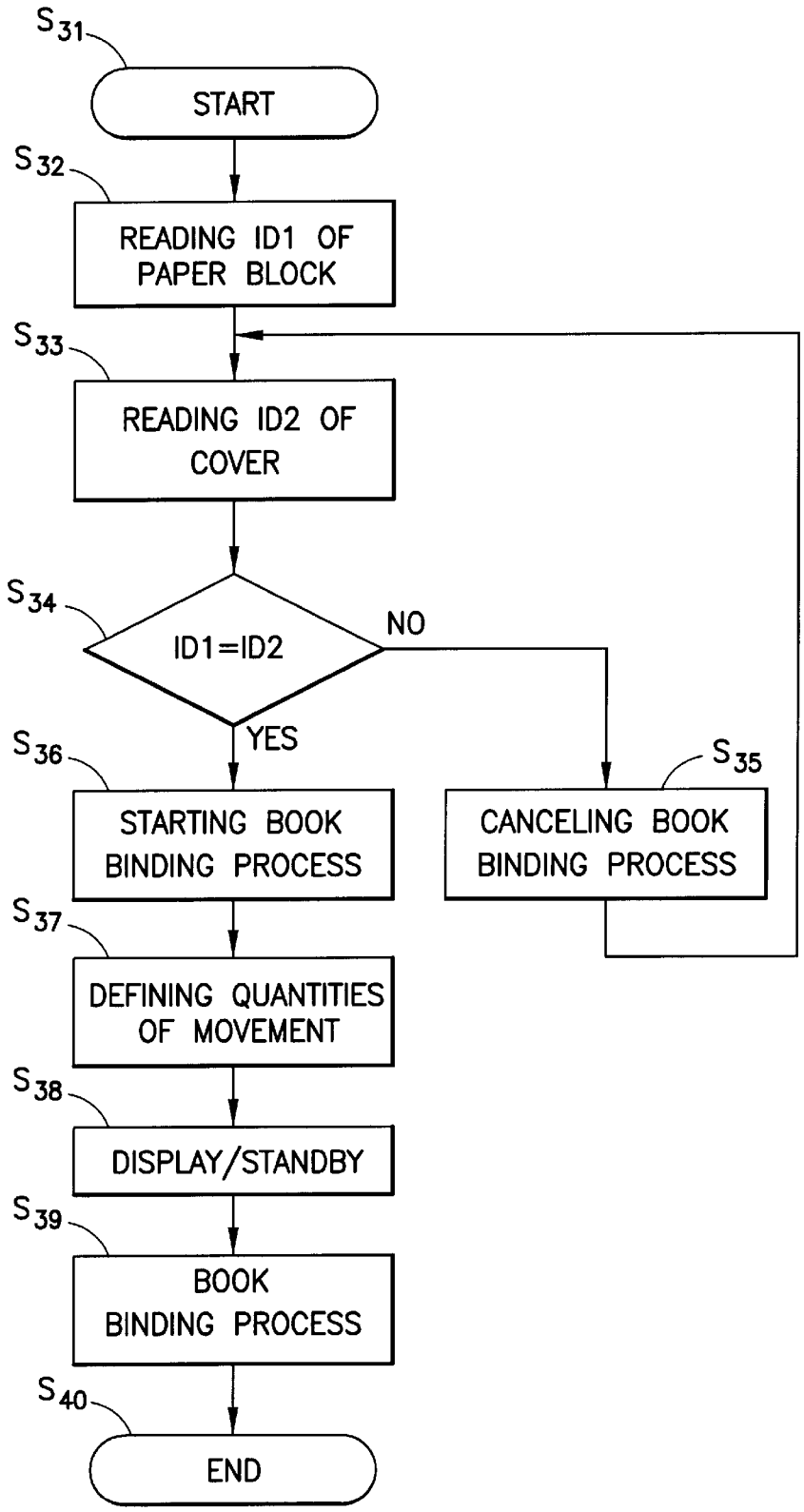
FIG. 6 is a flow chart for illustrating book binding steps performed in the arrangement of FIG. 5.

FIG. 6 is a flow chart for illustrating a procedure for regulating the respective quantities of movement of the laterally movable members of FIG. 5. Now, description will be made on the flow chart in FIG. 6.

First, a processing program is started at Step S31. Subsequently, the ID1 included in the printing information 2*b* of the paper block 2 is read out from the memory 72 at Step S32, which is followed by Step S33 to read from the memory 73 the ID2 included in the printing information 3*b* of the cover 3.

At Step S34, the ID1 is compared to the ID2. If the ID1 does not correspond to the ID2, the determination of 'N' is given whereby a command to cancel the processing is outputted at Step S35. This cancellation signal is displayed at the display A of the book binding apparatus 20.

In this case, the cover 3 is replaced with another cover 3, a printing information 3*b* of which is read by the second information reader 6*b*. Step S33 is performed again based on the printing information 3*b* supplied from the second information reader 6*b*, thereby to read out an ID2 included in the printing information 3*b* of the replacing cover 3. Then, Step S34 follows to compare the ID1 to the ID2. The processing steps of minor loop from Step S23 to Step S25 are repeated until the ID1 corresponds to the ID2.

If the ID1 corresponds to the ID2 at Step S33, the determination of 'Y' is given. Then at Step S36, a command to start the book binding process is supplied to the book binding apparatus 20. Subsequently, Step S37 follows to define respective quantities of movement of the laterally movable members of the book binding apparatus 20 based on the printing informations 2*b* and 3*b* of the paper block 2 and the cover 3. Based on the quantities of movement thus defined, the book-binding controller 7 supplies a control signal CS to the motors for driving the laterally movable members, respectively, whereby the clamping width, milling width and nipping width are automatically regulated.

After the termination of the automatic regulation of the quantities of movement of the laterally movable members, the control flow proceeds to Step S38 to output a signal indicative of the completion of preparation for the book binding process and to subject the signal to display at the display A of the book binding apparatus 20. Subsequently, the paper block 2 and the cover sheet 3 are fed to the book binding apparatus 20 for starting the book binding process at Step S39. The process is terminated at Step S40.

According to the example of FIG. 1, there are provided individual printing machines for the paper block and for the cover with the servers connected thereto via the transmission lines individually. However, an alternative arrangement may be made such that a common server and transmission line are connected to one printing machine which prints both the paper block and the cover. On the other hand, the arrangement of this example provides the information readers individually dedicated to the paper block and the cover but it is also possible to arrange the information reader to be shared by the both.

Although the description is made by way of the example wherein the bar code reader is used as the information reader, the information reader may employ any of such devices as infrared sensors, CCDs and the like that can read the coded printing information.

As described in the foregoing, the book binding apparatus according to the invention is adapted to read either of the printing informations of the cover and the paper block at a time for automatic settings for the book binding process based on the information thus read. This is effective to reduce time required for making settings for the book binding process and thence, labor of the operator.

Furthermore, the settings for the book binding process are made when the identifications of the paper block and the cover are in correspondence and therefore, an occurrence of human errors that a paper block and a cover in wrong correspondence are bound together.

In addition, the quantities of movement of the laterally movable members are automatically regulated based on the printing information of the paper block and the cover to be bound together and therefore, the quantities of movement of the laterally movable members can be regulated at improved efficiency.

While the presently preferred embodiments of the present invention have been shown and described, it is to be understood these disclosures are for the purpose of illustration and that various changes and modifications may be made without departing from the scope of the invention as set forth in the appended claims.

What is claimed is:

1. A book binding system performing book binding process for binding a sheet block together with a cover sheet so as to make a book or a booklet, comprising a transport passage for transporting the sheet block and the cover sheet, and a group of processing units sequentially inserted in the transport passage for performing the book binding process, each of said processing units having laterally movable members, a distance of the lateral movement of said laterally movable members being regulated according to a thickness or size of the sheet block, and a drive unit for movement of said laterally movable members, characterized in that said sheet block and said cover sheet have printing information inclusive of an identifying information thereof printed thereon, respectively, and that said book binding system further comprises an information reader for reading the printing information of the sheet block and the cover sheet, and a controller receiving said printing information from said information reader so as to determine whether the identifying information of the sheet block corresponds to the identifying information of the cover sheet or not, and outputting a stop signal of book binding process in case of no correspondence between both of the identifying information, while outputting to said processing units a start signal of book binding process and to said drive units of said processing units a control signal for movement of the associated laterally movable members by the distance corresponding to the thickness or the size of the sheet block based on the printing information of the sheet block and the cover sheet in case of correspondence between both of the identifying information.

2. The book binding system according to claim 1, characterized in that when said book binding system is designed to perform book binding process utilizing glue, said group of processing units comprise a process start unit, a milling unit, a gluing unit and a cover application unit which are arranged sequentially along the transporting direction, and that said laterally movable members of said processing units comprise clampers of said process start unit, width-adjustment plates of said milling unit, nipper plates of said cover application unit, respectively.

3. The book binding system according to claim 1, characterized in that when said book binding system is designed to perform book binding process utilizing a stitching head, said group of processing units comprise a process start unit, a stitching unit, a folding unit, a press unit and a product gathering unit which are arranged sequentially along the transporting direction, and that said laterally movable members of said processing units comprise clampers of said process start unit, a stitcher of said stitching unit, a fold knife and folding rollers of said folding unit and press plates of said press unit, respectively.

4. The book binding system according to claim 1, characterized in that said printing information of said sheet block includes the number of pages of the sheet block, a type of sheet, a thickness of a sheet, a type of cover sheet and identifying information for differentiation of the sheet block from other sheet blocks, and that said printing information of said cover sheet includes characteristic and type of sheet and identifying information for differentiation of the cover sheet from other cover sheets.

5. The book binding system according to claim 1, characterized in that said printing information is printed in a coded form on said sheet block and said cover sheet, and that said information reader comprises a bar code reader, infrared sensors or charge coupled devices (CCDs).

* * * * *

UNITED STATES PATENT AND TRADEMARK OFFICE

CERTIFICATE OF CORRECTION

PATENT NO. : 6,206,358 B1
DATED : March 27, 2001
INVENTOR(S) : Katsumi Yamaguchi et al.

It is certified that error appears in the above-identified patent and that said Letters Patent is hereby corrected as shown below:

Column 10,
Line 47, delete "1," and insert -- 4 --.

Signed and Sealed this

Twenty-fourth Day of January, 2006

JON W. DUDAS
*Director of the United States Patent and Trademark Office*